US009651347B2

(12) United States Patent
Rodriguez et al.

(10) Patent No.: US 9,651,347 B2
(45) Date of Patent: May 16, 2017

(54) SHOTGUN SHELL CARRIER

(71) Applicant: Safariland, LLC, Jacksonville, FL (US)

(72) Inventors: Gerald Rodriguez, Rancho Cuoamonga, CA (US); Bobby McGee, Rancho Cuoamonga, CA (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 15/175,587

(22) Filed: Jun. 7, 2016

(65) Prior Publication Data

US 2017/0010083 A1 Jan. 12, 2017

Related U.S. Application Data

(60) Provisional application No. 62/181,586, filed on Jun. 18, 2015.

(51) Int. Cl.

| | |
|---|---|
| ***F42B 39/02*** | (2006.01) |
| *A45F 5/02* | (2006.01) |
| *F42B 39/00* | (2006.01) |

(52) U.S. Cl.

CPC ..... *F42B 39/02* (2013.01); *A45F 5/021* (2013.01); *A45F 2200/0591* (2013.01); *F42B 39/002* (2013.01); *Y10S 224/931* (2013.01)

(58) Field of Classification Search

CPC ..... A45F 2200/0591; A45F 5/021; A45F 2200/0566; F42B 39/02; F42B 39/002; Y10S 224/931

USPC ..... 224/931; D3/262

See application file for complete search history.

(56) References Cited

U.S. PATENT DOCUMENTS

| | | | | | |
|---|---|---|---|---|---|
| 560,618 | A * | 5/1896 | Lane | A45F 5/02 | 224/247 |
| 1,073,721 | A * | 9/1913 | Uren | A45F 5/02 | 224/242 |
| 1,464,659 | A * | 8/1923 | Keely | A45F 5/021 | 224/247 |
| 2,477,806 | A * | 8/1949 | Isaacson | F41A 9/83 | 224/247 |
| 2,670,886 | A * | 3/1954 | Walton | F42B 27/00 | 224/191 |
| 3,001,678 | A * | 9/1961 | Maxwell | F42B 39/02 | 211/72 |
| 3,153,500 | A * | 10/1964 | Pachmayr | F42B 39/02 | 206/3 |
| 3,190,514 | A * | 6/1965 | Spilman | F42B 39/02 | 206/3 |
| 3,219,244 | A * | 11/1965 | Blask | F42B 39/002 | 221/185 |
| 5,924,613 | A * | 7/1999 | Johnson | A45F 5/02 | 2/94 |

(Continued)

OTHER PUBLICATIONS

Photographs of admitted prior art carriers.

*Primary Examiner* — Justin Larson

(74) *Attorney, Agent, or Firm* — Kane Kessler, P.C.; Paul E. Szabo

(57) ABSTRACT

A shotgun shell carrier includes two clips on opposite ends of a bracket, for holding two shells end to end. Each clip has a shell end compartment for receiving an end portion of a shelf. Each clip has a hood that extends over the shell end compartment to block longitudinal movement of the shell out of the clip.

11 Claims, 6 Drawing Sheets

(56) References Cited

U.S. PATENT DOCUMENTS

| | | | | |
|---|---|---|---|---|
| 6,253,481 | B1 * | 7/2001 | Melby | F41A 9/72 224/251 |
| 6,520,350 | B1 * | 2/2003 | Smith | B25H 3/04 211/74 |
| 6,817,135 | B1 * | 11/2004 | Jackson | F42B 39/002 206/3 |
| 7,669,742 | B2 * | 3/2010 | Rush | A45F 5/00 102/336 |
| 8,028,826 | B1 * | 10/2011 | Woo | F42B 39/14 206/3 |
| 8,060,948 | B2 * | 11/2011 | Pesic | A45F 5/00 2/161.5 |
| 8,528,245 | B2 * | 9/2013 | Chvala | F42B 39/002 224/251 |
| 8,613,157 | B2 * | 12/2013 | McCaffery | F42B 39/02 224/931 |
| 8,931,633 | B2 * | 1/2015 | Martin, III | F41A 9/85 206/3 |
| 8,960,497 | B2 * | 2/2015 | Lefeber | F42B 39/26 221/197 |
| D753,260 | S * | 4/2016 | Solovov, Jr. | D22/116 |
| 9,322,626 | B2 * | 4/2016 | Ballard | F42B 39/26 |
| 2006/0010752 | A1 * | 1/2006 | Rogers | F42B 39/002 42/90 |
| 2010/0139048 | A1 * | 6/2010 | Pesic | A45F 5/00 24/3.2 |
| 2012/0285066 | A1 * | 11/2012 | Chvala | F42B 39/28 42/90 |
| 2014/0124387 | A1 * | 5/2014 | Iannello | F42B 39/02 206/3 |
| 2015/0292847 | A1 * | 10/2015 | Sturm | F42B 39/02 206/3 |
| 2016/0313105 | A1 * | 10/2016 | Olroyd | F42B 39/02 |

* cited by examiner

SHOTGUN SHELL CARRIER

BACKGROUND OF THE INVENTION

A competition shotgun shooter needs to be able to reload the shotgun quickly and reliably. To that end, shotgun shell carriers are known that enable a user to removably retain a plurality of shotgun shells, on the users belt for example, in a condition in which they can easily be grasped for insertion into the shotgun. Such known carriers do not securely prevent longitudinal movement of the shells: as a result, if the user humps into something or bumps the carrier with the gun, the shells can come out of the carrier. The present invention addresses that problem.

DETAILED DESCRIPTION

Figure 1:
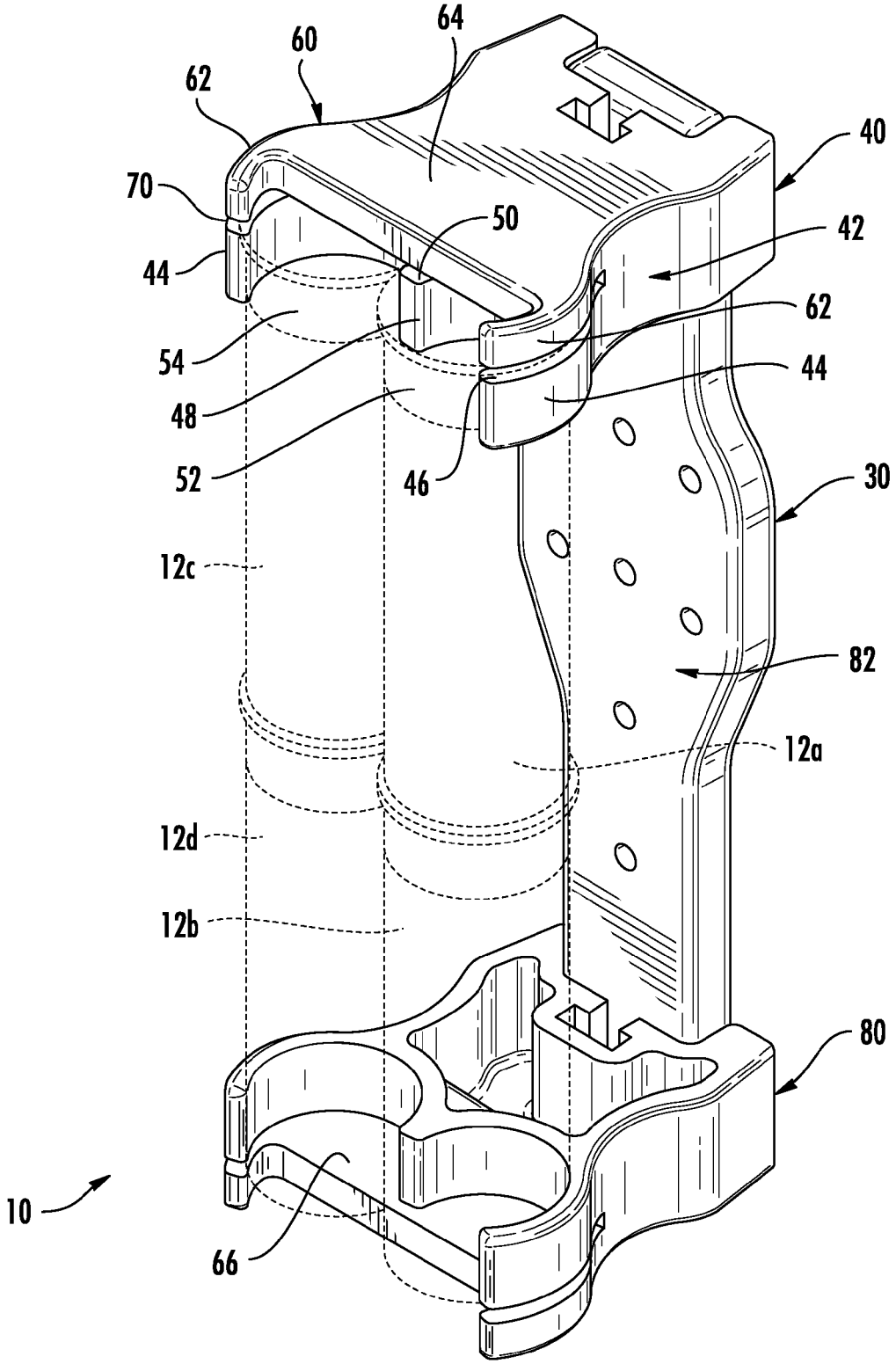
FIG. 1 is a perspective view of a four shell carrier that is a first embodiment of the invention, showing four shells in phantom for clarity.
Figure 2:
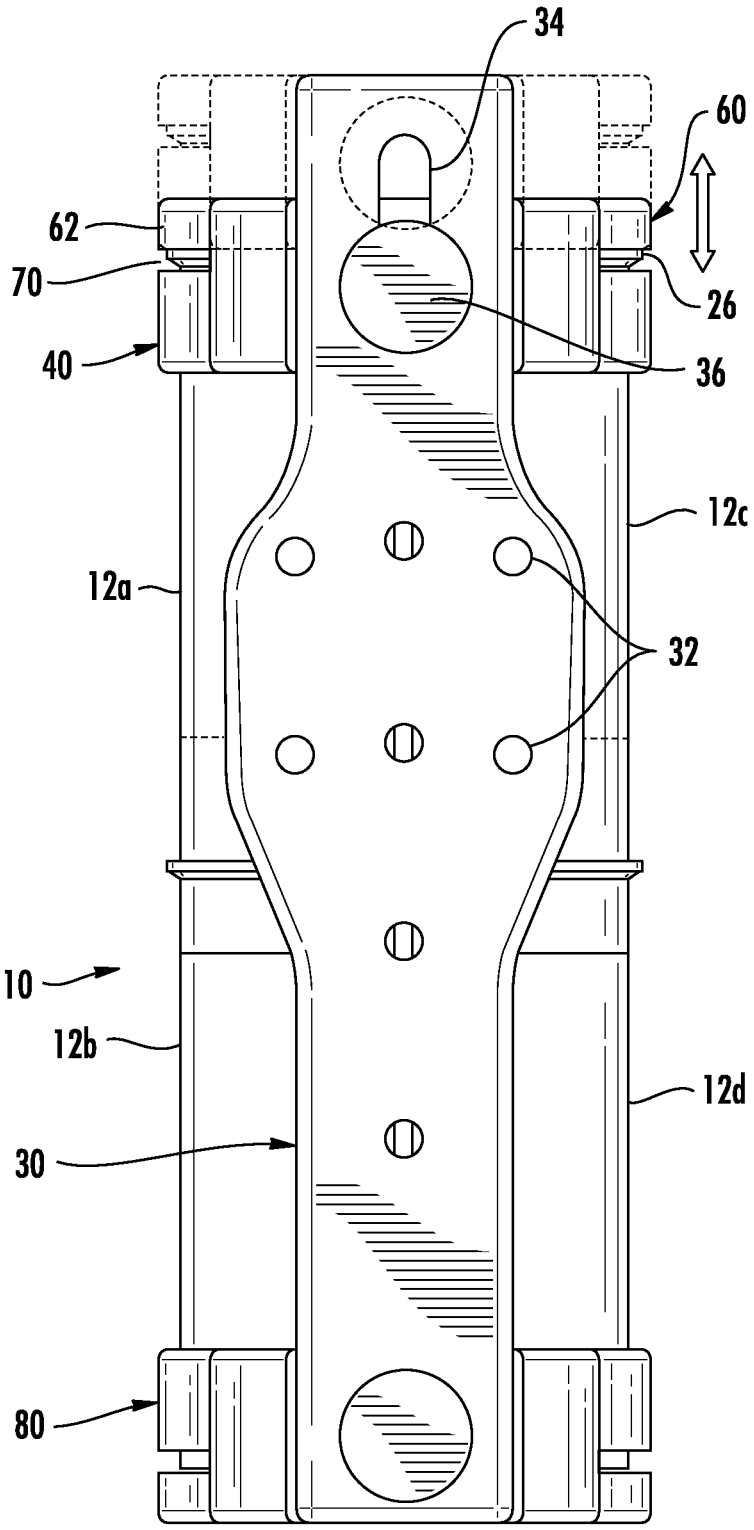
FIG. 2 is a back elevational view of the carrier of FIG. 1, showing the shells in full
Figure 3:
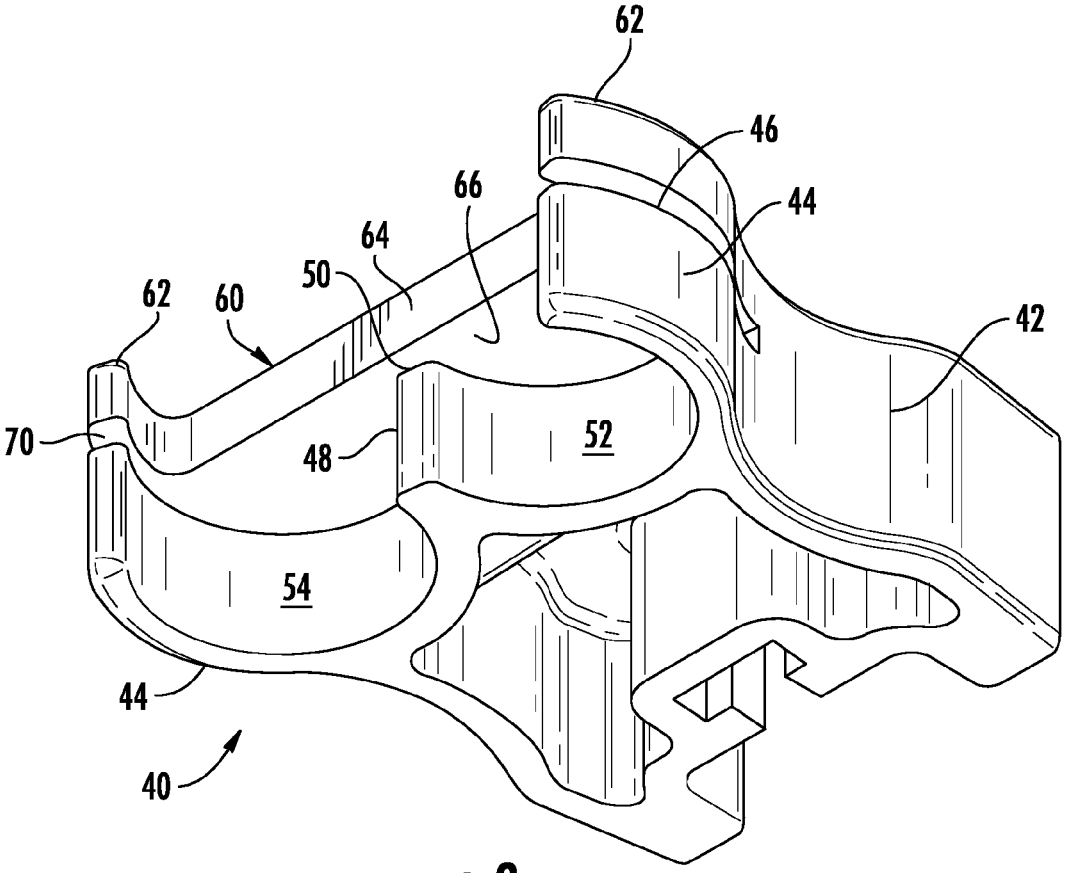
FIG. 3 is a perspective view of a clip that is part of the carrier of FIG. 1.

FIGS. 1 -5 illustrate a carrier 10 that is a first embodiment of the invention The carrier 10 (FIG. 1) includes a bracket 30, a first or upper clip 40, and a second or lower clip 80. The terms "upper" and "lower" are used for convenience herein because of the orientation in which the carrier 10 is typically worn and used; the carrier may of course be worn and/or used In a different orientation.

The carrier 10 is configured to accommodate a plurality of shotgun shells 12, shown for example at 12*a*-12*d*. A typical shotgun shell 12 (FIG. 4) of the type that the carrier is used with has a right cylindrical configuration with a main body portion 14 having a cylindrical outer surface 18 centered on a longitudinal central axis of the shell. The outer surface 16 extends between a base end 18 of the shell 12 and an outer end 20 of the shell.

The base end 18 of the shell 12 has a base 22 that is typically copper or brass and that includes a circular first outer end surface 24 of the shell. The base 22 includes an annular, radially projecting rim 26 that circumscribes the first end surface 24 and that is larger in diameter than the cylindrical outer surface 24. The opposite outer end 20 of the shell 12 includes a circular second end surface 28 of the shell.

A carrier in accordance with the present invention can be constructed to accommodate either two, or four, or eight shells. The four-shell model 10 is described in detail herein. The two-shell model and the eight-shell model are described briefly thereafter.

The bracket which forms part of the carrier 10, can be any structure or device that holds the upper and lower clips 40 and 80 in spaced apart relation to each other The particular bracket 30 that is illustrated (FIGS. 1 and 3) has an elongate configuration with one or more fastener openings 32 that can receive fasteners (not shown) for supporting the bracket, for example by means of a belt clip. Other types and configurations of brackets 30 can be used.

The bracket 30 has a slot 34 or similar feature for enabling vertical adjustment of the position of the upper clip 40 on the bracket. A screw or other fastener 36 can fix the upper clip 40 in a selected vertical position on the bracket 30, in a known manner. The lower clip 80 is fixed in position on the bracket 30. Alternatively, the upper clip 40 can be fixed in position on the bracket, with the lower clip 80 being adjustable, or both clips can be adjustable, For lower manufacturing costs, the lower clip 80 is. In the illustrated embodiment, identical to the upper clip 40, but oriented upside down, and so it will not be described in detail, although it is given similar reference numerals.

Figure 4:
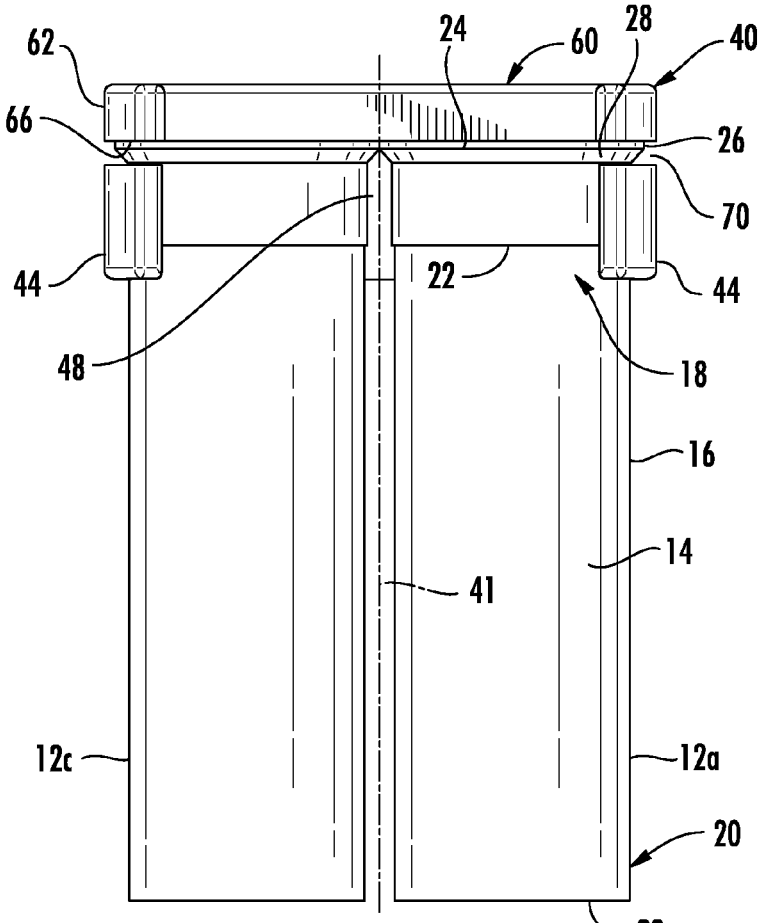
FIG. 4 is a front elevational view of a portion of the carrier of FIG. 1 showing two shells in full.
Figure 5:
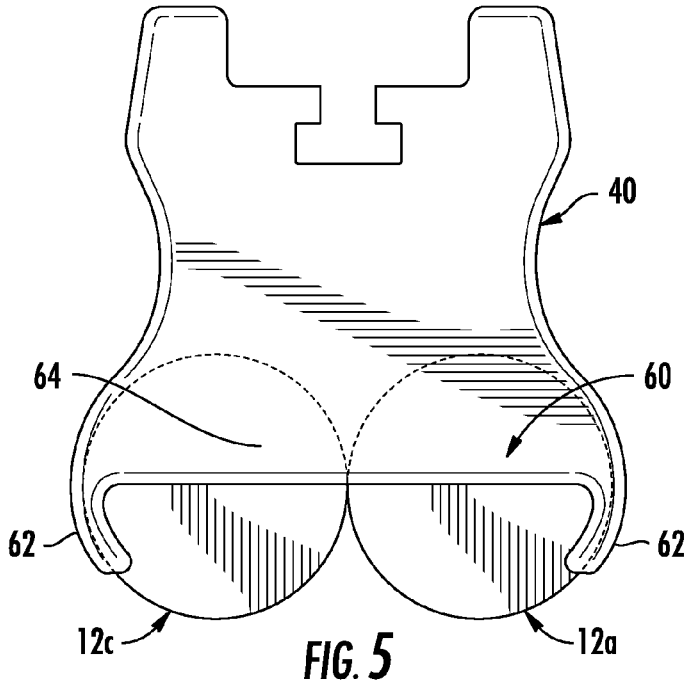
FIG. 5 is a top plan view of a portion of the carrier of FIG. 1.

The upper clip 40 (FIG. 3) is left-right symmetrical about a central or "sagittal" plane 41 that extends front to back, as viewed in FIG. 4. The upper clip 40 (FIG. 3) has a main body portion 42 that receives the bracket fastener 36. Two generally C-shaped arms 44 extend outward from the main body portion 42, adjacent to each other. Each arm 44 has an upper edge surface 46. A central rib 48 is located between the two arms 44. The central rib 48 has an upper edge surface 50. The rib 48 and the two arms 44 together define two shell end compartments 52 and 54 In the clip 40, side by side and adjacent to each other.

The arms 44 are resilient, and may be moved slightly in towards, and out away from, the central rib 48. Each arm 44 is configured to resiliently grasp the cylindrical outer surface 24 of a shell 12, and hold it against the central rib 48, with the shell base 22 thus being received and held in the shell end compartment 52 or 54.

The clip 40 includes means for preventing longitudinal movement of the shells out of the carrier 10. Specifically, in the illustrated embodiment, the clip 40 includes a hood 60 that extends over the outer end of the clip The hood 60 is a generally planar element with a narrow portion 62 on each end that is shaped like and overlies the two arms 44. A central portion 64 of the hood 60 overlies the central rib 48 and the two shell end compartments 52 and 54. The hood 60 has a lower major side surface 66. In the illustrated embodiment, the hood 60 extends over about 40% to 50% of the end surface of the shells. Other sizes and configurations are possible.

The hood 60 is spaced vertically apart from the arms 44 and from the central rib 48, thereby defining a slot 70 that extends the width of the clip 40: above each arm 44 and above the central rib 48. The slot 70 is configured to receive the rim 26 of a shell and is thus substantially the same height as the thickness of a shell rim.

In use of the carrier 10, the base 22 of a first shell 12*a* is inserted into the first shell end compartment 52. Specifically, the base 22 is pressed into the shell end compartment 52 between the arm 44 and the central rib 48, camming the arm out slightly. When the base 22 is fully in the compartment 52, the arm 44 resiliency grasps the shell base, holding it laterally against the central rib 48.

At the same time, the rim 26 of the shell base 22 moves Into the slot 70. The upper edge surface 46 of the clip arm 44 encages an annular, radially extending surface 72 of the rim 26. The lower major side surface 66 of the hood 60 engages the circular first end surface 24 of the shell 12. As a result, the rim 26 is captured between the hood 70 and the arm 44.

The shell 12*a* is, thus, securely but removably held in the carrier 10, Specifically, the central rib 48 and the arm 44 act together to block lateral movement of the shell 12*a*. The engagement of the arm 44 with the shell rim 26 blocks movement of the shell 12*a* in a first longitudinal direction along the carrier 10, that is, in a direction toward the second clip 80. The engagement of the hood 60 with the shell end surface 24 blocks movement of the shell 12*a* in a second longitudinal direction along the length of the carrier 10, that is, in a direction away from the second clip 80.

A second shell 12*b* is inserted into the second clip 80, at the opposite end of the bracket 30. The outer end 20 of the second shell 12*b* is grasped between the arm 44 and the central rib 48 of the second clip 80 to block lateral movement of the second shell. The second end surface 28 of the second shell 12*b* engages the hood 70 on the second clip 80 to block movement of the second shell in the first longitudinal direction along the earner, that is, in a direction away from the first clip 40.

The distance between the first and second clips 40 and 80 is selected by the user so that the base end 18 of the second shell 12*b* abuttingly engages the outer end 20 of the first shell 12. This engagement blocks movement of the second shell 12*b* in the second longitudinal direction along the carrier 10, that is, in a direction toward the first clip 40.

Because the respective hoods 80 of the first and second clips 40 and 80 block outward longitudinal movement of the shells 12*a* and 12*b* m the carrier 10, and because the clips hold the two shells together longitudinally, the shells are much more secure in the carrier. Accidental bumping of the carrier 10 and/or the shells 12*a* and 12*b* is less likely to dislodge the shells from the carrier.

As shown in FIG. 1, another pair of first and second shells 12*c* and 12*d* may be retained in the carrier 10 also, in the same manner, on the opposite lateral side of the carrier. All four shells 12*a*-12*d* are securely but removably retained in the carrier 10.

When shells 12 are thus in place In the carrier 10, there is a gap 82 between the shells and the bracket 30. This gap 82 enables the user to grasp two shells and easily remove them from the carrier 10 by pulling them out from the resilient arms 44.

Figure 6:
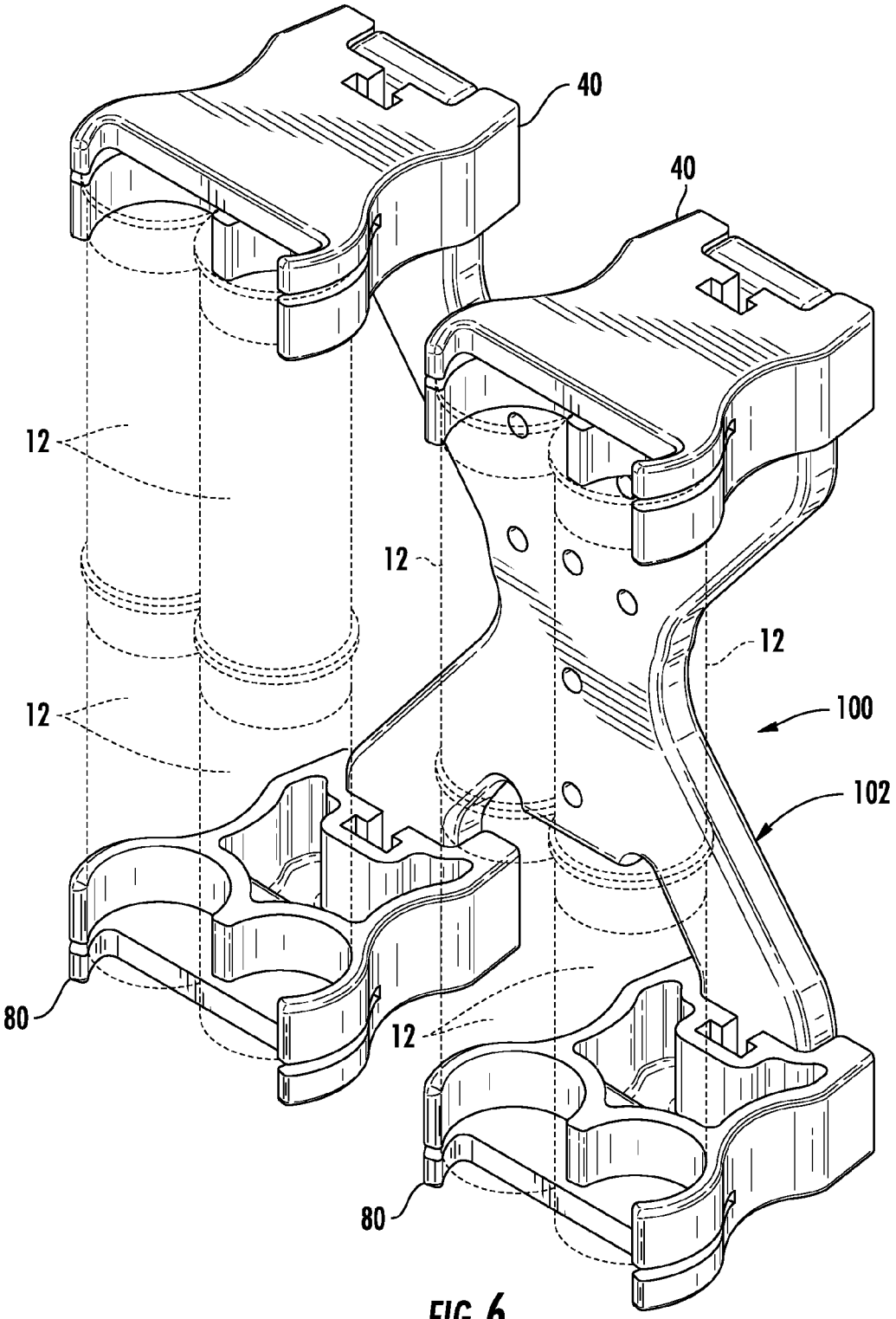
FIG. 6 is a perspective view of an eight shell carrier that is a second embodiment of the invention.

FIG. 6 illustrates a carrier 100 that is a second embodiment of the invention. The carrier 100 is configured to hold eight shotgun shells 12. Two upper clips 40 and two lower clips 80 are mounted on an X-shaped bracket 102. The clips 40 and 80 may be identical to the clips of the first embodiment.

Figure 7:
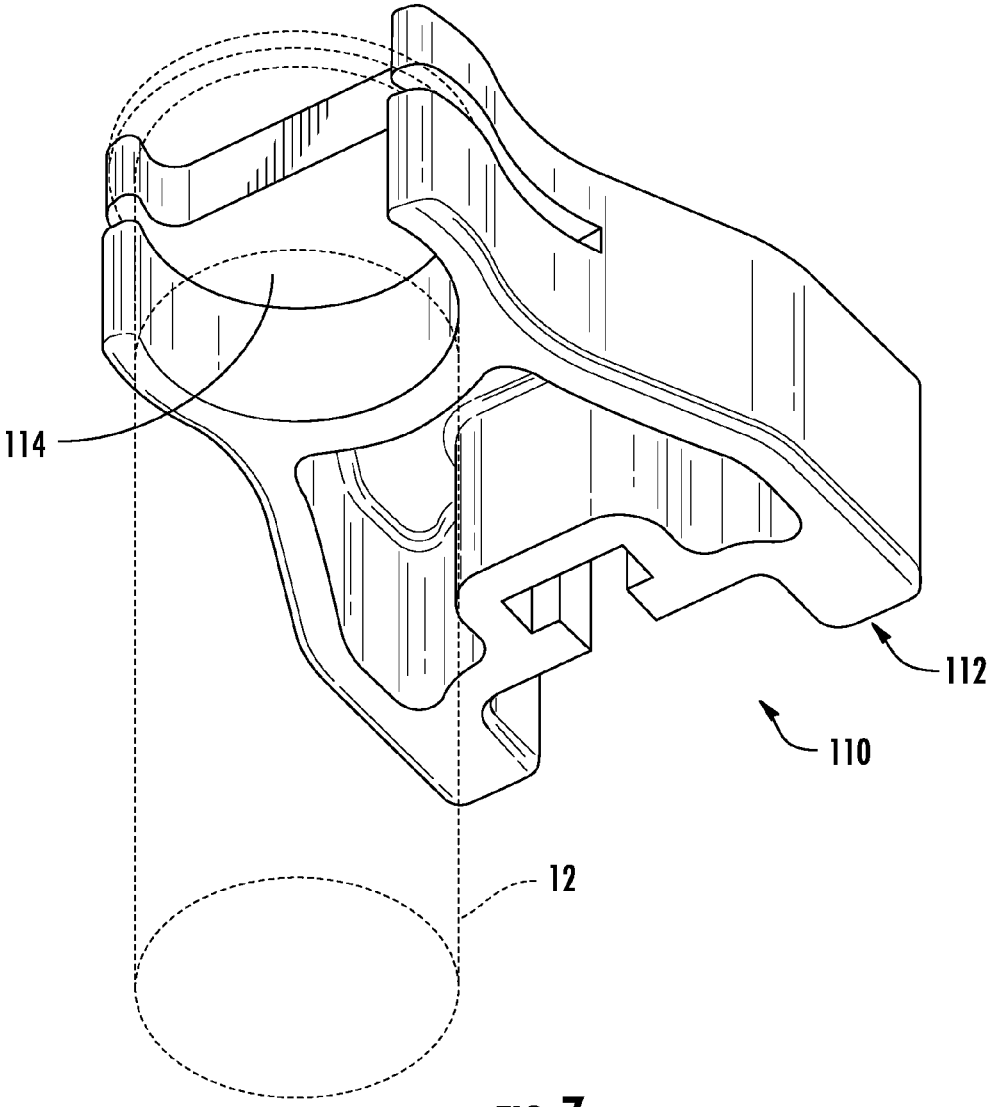
FIG. 7 is a perspective view of a two shell carrier that is a third embodiment of the invention.

FIG. 7 illustrates a portion of a carrier 110 that is a third embodiment of the invention. The carrier 110 is configured to hold only two shotgun shells 12. The carrier 110 includes an upper clip 112 with a single shell end compartment 114. The bracket and the identical lower clip of the carrier 110 are not shown. The clip 112 may be functionally the same as the clips 40 and 70 of the first embodiment.

The invention claimed is:

1. A carrier configured to carry a plurality of shotgun shells of the type having a cylindrical configuration with a cylindrical outer surface extending between first and second opposite circular end surfaces, a first end of each shell being a base end with a rim that projects radially outward from the cylindrical outer surface and that circumscribes the first end surface, and a second end of each shell being an outer end opposite the base end and including the second end surface, the carrier comprising:

a bracket; and first and second clips supported on the bracket at locations spaced apart from each other along the length of the bracket;

the first clip having a first arm for resiliency gripping the base end of a first shell to retain the first shell on the carrier with its outer end presented toward the second clip, the first clip having a hood above the first arm and a slot between the hood and the first arm for receiving therein the rim of the first shell, the hood engaging the first end surface of the first shell when the first shell is gripped by the first arm and blocking movement of the first shell out of the first clip in a direction away from the second clip;

the second clip having a second arm gripping the outer end of a second shell to retain the second shell on the carrier with its base end presented toward the first clip and the first shell, the second clip having a hood engaging the second end surface of the second shell when the second shell is gripped by the second arm and blocking movement of the second shell out of the second clip in a direction away from the first clip;

the relative positions of the first and second clips on the bracket being selected to cause the base end of the second shell to abut the outer end of the first shell when the first and second shells are thus retained on the carrier.

2. A carrier as set forth in claim 1 wherein the hood extends over about 40% to 45% of the first end surface of a first shell.

3. A carrier as set forth in claim 1 wherein the hood is planar.

4. A carrier as set forth in claim 1 wherein the rim of the first shell is captured between the first arm and the hood.

5. A carrier as set forth in claim 1 wherein the hood extends over about 40% to 45% of the first end surface of a first shell, the hood is planar, and the rim of the first shell is captured between the first arm and the hood.

6. A carrier as set forth in claim 1 wherein the first clip includes a central rib opposite the first arm, the first arm being resiliently movable toward and away from the central rib; the first shell base being gripped laterally between the first arm and the central rib, and wherein the hood extends across the space between the first arm and the central rib.

7. A carrier as set forth in claim 1 wherein the first clip further includes a third arm on the opposite side of the central rib from the first arm and configured to grip a third shell side-by-side with the first shell, and the second clip further includes a fourth arm on the opposite side of the central rib from the second arm and configured to grip a fourth shell side-by-side with the second shell.

8. A carrier as set forth in claim 1 wherein the second clip is identical to the first clip and is supported on the bracket below the first clip and in an orientation upside down from the first clip.

9. A carrier as set forth in claim 1 configured for supporting exactly four shotgun shells.

10. A carrier as set forth in claim 1 configured for supporting exactly eight shotgun shells.

11. A carrier as set forth in claim 1 configured for supporting exactly two shotgun shells.

* * * * *